US008757291B2

(12) United States Patent
Kumar et al.

(10) Patent No.: US 8,757,291 B2
(45) Date of Patent: Jun. 24, 2014

(54) AT-BIT EVALUATION OF FORMATION PARAMETERS AND DRILLING PARAMETERS

(75) Inventors: Sunil Kumar, Celle (DE); Hendrik John, Celle (DE); Dan Scott, Montgomery, TX (US); Anthony DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 437 days.

(21) Appl. No.: 13/093,289

(22) Filed: Apr. 25, 2011

(65) Prior Publication Data

US 2011/0266054 A1 Nov. 3, 2011

Related U.S. Application Data

(60) Provisional application No. 61/408,119, filed on Oct. 29, 2010, provisional application No. 61/408,106, filed on Oct. 29, 2010, provisional application No. 61/328,782, filed on Apr. 28, 2010, provisional application No. 61/408,144, filed on Oct. 29, 2010.

(51) Int. Cl.

| | |
|---|---|
| ***E21B 12/02*** | (2006.01) |
| ***E21B 47/01*** | (2012.01) |
| ***E21B 10/46*** | (2006.01) |

(52) U.S. Cl.

USPC ..... 175/50; 175/39; 175/432

(58) Field of Classification Search

USPC ..... 175/50, 428, 39, 327, 374, 433, 432

See application file for complete search history.

(56) References Cited

U.S. PATENT DOCUMENTS

| | | | | |
|---|---|---|---|---|
| 4,645,977 | A | | 2/1987 | Kurokawa et al. |
| 4,707,384 | A | | 11/1987 | Schachner et al. |
| 4,785,894 | A | | 11/1988 | Davis et al. |
| 4,785,895 | A | * | 11/1988 | Davis et al. ..... 175/39 |
| 4,976,324 | A | | 12/1990 | Tibbitts |
| 5,066,938 | A | | 11/1991 | Kobashi et al. |
| 5,317,302 | A | | 5/1994 | Yamazaki |
| 5,337,844 | A | | 8/1994 | Tibbitts |
| 5,512,873 | A | | 4/1996 | Saito et al. |
| 5,523,121 | A | | 6/1996 | Anthony et al. |
| 5,706,906 | A | | 1/1998 | Jurewicz et al. |
| 5,881,830 | A | | 3/1999 | Cooley |
| 6,068,070 | A | | 5/2000 | Scott |

(Continued)

FOREIGN PATENT DOCUMENTS

| | | |
|---|---|---|
| JP | 11-101091 | 4/1999 |
| JP | 2000225511 A | 8/2000 |
| WO | 2011139696 | 11/2011 |

OTHER PUBLICATIONS

Battaglia, J. et al., "Estimation of Heat Fluxes During High-Speed Drilling," Int. Jnl. Adv. Manf. Technol., vol. 26, pp. 750-758 (2005).

(Continued)

*Primary Examiner* — Jennifer H Gay

(74) *Attorney, Agent, or Firm* — Cantor Colburn LLP

(57) ABSTRACT

An apparatus for forming a wellbore in a formation may include a bit body and a sensor in the bit body. The sensor may include at least one cutting element and may be configured to generate information relating to a parameter of interest when the drill bit engages a wellbore surface.

14 Claims, 4 Drawing Sheets

(56) References Cited

U.S. PATENT DOCUMENTS

| | | | | |
|---|---|---|---|---|
| 6,274,403 | B1 | 8/2001 | Klages et al. | |
| 6,571,886 | B1 * | 6/2003 | Sullivan et al. | 175/40 |
| 6,612,384 | B1 | 9/2003 | Singh et al. | |
| 6,626,251 | B1 * | 9/2003 | Sullivan et al. | 175/40 |
| 7,052,215 | B2 * | 5/2006 | Fukano | 407/113 |
| 7,066,280 | B2 * | 6/2006 | Sullivan et al. | 175/40 |
| 7,301,223 | B2 * | 11/2007 | Rodney et al. | 257/629 |
| 7,338,202 | B1 | 3/2008 | Kapat et al. | |
| 7,604,072 | B2 | 10/2009 | Pastusek et al. | |
| 7,697,375 | B2 | 4/2010 | Reiderman et al. | |
| 7,946,357 | B2 * | 5/2011 | Trinh et al. | 175/50 |
| 8,195,438 | B2 | 6/2012 | Singh et al. | |
| 8,215,384 | B2 * | 7/2012 | Trinh et al. | 166/177.1 |
| 2001/0054514 | A1 * | 12/2001 | Sullivan et al. | 175/40 |
| 2004/0069539 | A1 * | 4/2004 | Sullivan et al. | 175/337 |
| 2004/0184700 | A1 | 9/2004 | Li et al. | |
| 2004/0222018 | A1 * | 11/2004 | Sullivan et al. | 175/39 |
| 2005/0230149 | A1 | 10/2005 | Boucher et al. | |
| 2006/0018360 | A1 | 1/2006 | Tai et al. | |
| 2007/0056171 | A1 | 3/2007 | Taryoto | |
| 2007/0092995 | A1 | 4/2007 | Datta et al. | |
| 2007/0186639 | A1 | 8/2007 | Spross et al. | |
| 2008/0257730 | A1 | 10/2008 | Jiang et al. | |
| 2009/0114628 | A1 | 5/2009 | DiGiovanni | |
| 2010/0038136 | A1 * | 2/2010 | Trinh et al. | 175/40 |
| 2010/0083801 | A1 | 4/2010 | Li et al. | |
| 2010/0089645 | A1 | 4/2010 | Trinh et al. | |
| 2010/0270085 | A1 | 10/2010 | Turner et al. | |
| 2010/0326731 | A1 | 12/2010 | Swietlik et al. | |
| 2011/0168446 | A1 | 7/2011 | Lemenager et al. | |
| 2011/0253448 | A1 * | 10/2011 | Trinh et al. | 175/50 |
| 2011/0266054 | A1 * | 11/2011 | Kumar et al. | 175/39 |
| 2011/0266055 | A1 * | 11/2011 | DiGiovanni et al. | 175/50 |
| 2011/0266058 | A1 * | 11/2011 | Kumar et al. | 175/57 |
| 2012/0132468 | A1 * | 5/2012 | Scott et al. | 175/50 |
| 2012/0312598 | A1 * | 12/2012 | Cheng | 175/50 |
| 2012/0312599 | A1 * | 12/2012 | Trinh et al. | 175/57 |
| 2012/0325564 | A1 * | 12/2012 | Vaughn et al. | 175/428 |
| 2013/0068525 | A1 * | 3/2013 | DiGiovanni | 175/40 |
| 2013/0147633 | A1 * | 6/2013 | Sumrall et al. | 340/854.4 |

OTHER PUBLICATIONS

Zhang, X., et al., "Design, Fabrication, and Characterization of Metal Embedded Microphotonic Sensors," Jnl. Manuf. Sci. Eng., vol. 130, No. 3, 031104 (2008).

Cheng, X. et al., "Development of Metal Embedded Microsensors by Diffusion Bonding and Testing in Milling Process," Jnl. Manuf. Sci. Eng., vol. 130, No. 6, 061010 (2008).

European Patent Office, Third Party Observation for application No. EP20110777912 dated Jun. 4, 2013, pp. 1-7.

Hornstvedt, G. et al.; "PDC-Bit Evaluation by Cutter Instrumentation and Computer Simulation", SPE 19570, 64th Annual Technical Conference and Exhibition of the Society of Petroleum Engineers, San Antonio, TX, Oct. 9-11, 1989, pp. 509-520.

* cited by examiner

AT-BIT EVALUATION OF FORMATION PARAMETERS AND DRILLING PARAMETERS

CROSS-REFERENCE TO RELATED APPLICATIONS

This application claims priority from U.S. provisional patent application Ser. No. 61/408,119 filed on Oct. 29, 2010; U.S. provisional patent application Ser. No. 61/408,106 filed on Oct. 29, 2010 U.S. provisional patent application Ser. No. 61/328,782 filed on Apr. 28, 2010; and U.S. provisional patent application Ser. No. 61/408,144 filed on Oct. 29, 2010.

BACKGROUND OF THE DISCLOSURE

1. Field of the Disclosure

The disclosure herein relates generally to the field of cutters used to form boreholes.

2. Background of the Art

Wellbores are usually formed in a formation of interest using a drill string that includes a bottomhole assembly ("BHA") having a drill bit attached to the bottom end thereof. The drill bit is rotated to disintegrate the earth formations to drill the wellbore. Information relating to the condition of the BHA/drill bit and the formation surrounding the wellbore being drilled may be useful in efficiently and cost-effectively constructing a well. For instance, knowledge of the drilling dynamics affecting the drill bit may be used to adjust drilling parameters (e.g., weight-on-bit or RPM) or evaluate the effectiveness of the cutting action of the drill bit. Information relating to the formation may be use useful to characterize the lithology of a formation or identify features of interest (e.g., bed boundaries).

The present disclosure is directed to obtaining information relating to the drill bit and the formation, as well as other information that may be used to enhance drilling operations.

SUMMARY OF THE DISCLOSURE

In aspects, the present disclosure provides an apparatus for forming a wellbore in a formation. The apparatus may include a bit body and a sensor in the bit body. The sensor may include at least one cutting element and may be configured to generate information relating to a parameter of interest when the drill bit engages a wellbore surface.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

In aspects, the present disclosure provides a drill bit that evaluates the formation being drilled and/or measures one or more drilling dynamics parameters. The information obtained by the drill bit may be used to characterize the formation, monitor the health or condition of the drill bit, and/or adjust drilling parameters to optimize drilling (e.g., increase rate of penetration (ROP), reduce unfavorable vibrations, etc.). Merely for ease of explanation, a tricone drill bit is referred to in the discussion below. However, it should be understood that the term "drill bit" encompasses all types of earth-boring drill bits; e.g., drag bits, PCD bits, hybrid bits, coring bits, reamers, hole openers, etc.

Figure 1:
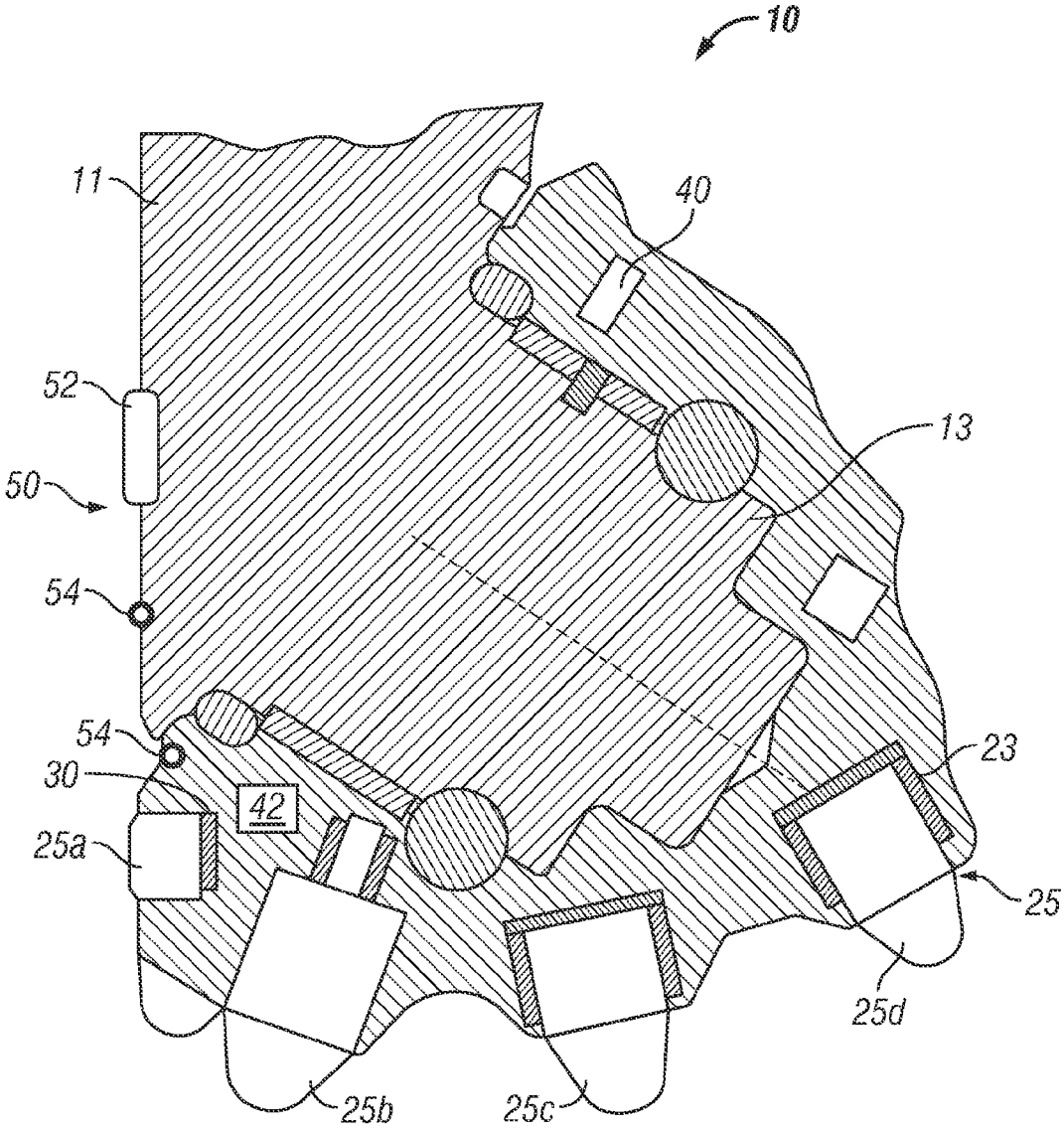
FIG. 1 illustrates a sectional view of one embodiment of a cutting tool made in accordance with the present disclosure.

Referring to FIG. 1, an exemplary drill bit 10 has a body 11 that has three depending legs, although only one is shown. Each leg of bit body 11 has a bearing pin 13 that extends downward and inward toward the axis of rotation of the bit 10. A cone 23 mounts on and rotates relative to bearing pin 13. Cone 23 has a plurality of cutting elements 25, which in this embodiment are shown to be tungsten carbide inserts press-fitted into mating holes in cone 23. For ease of discussion, representative cutting elements have been labeled 25A-D. As will be described in greater detail below, the cuttings elements 25 and/or the bit body 11 may be instrumented with sensors that provide information relating to the drill bit 10 and/or the surrounding formation.

Figure 2:
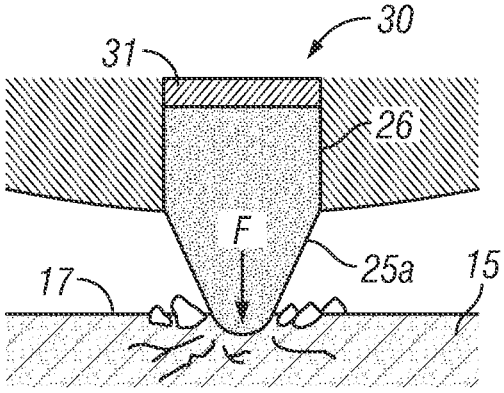
FIG. 2 schematically illustrates a cutting element having a sensing element according to one embodiment of the present disclosure.

Referring now to FIGS. 1 and 2, in one embodiment, the sensor 30 may include the cutting element 25A that may be operatively coupled to a sensing element 31. By operatively coupled, it is generally meant that a condition, behavior, or response relating to the cutting element 25A may be directly or indirectly transferred to or detected by the sensing element 31. Operative couplings may include, but are not limited to, electrical couplings wherein an electrical circuit is formed using the cutting element 25A and the sensing element 31 and dynamic couplings wherein movement or motion of the cutting element 25A is transferred in some form to the sensing element 31. In some embodiments, the sensing element 31 may be formed at least partially of a material that may generate a signal in response to a condition of the cutting element 25A For example, the material making up the sensing element 31 may generate a signal when an interaction or co-action between the cutting element 25A and the sensing element 31 causes a change in one or more material properties (volume, shape, deflection, elasticity, etc.). Suitable materials include, but are not limited to, electrorheological (ER) material that are responsive to electrical current, magnetorheological (MR) fluids that are responsive to a magnetic field, piezoelectric materials that are responsive to an electrical current, electro-responsive polymers, flexible piezoelectric fibers and materials, and magneto-strictive materials. The generated signal(s) may correspond to a downhole parameter of interest related to the formation 15 and/or the drill bit 11. Illustrative downhole parameters include, but are not limited to, stress, strain, weight-on-bit (WOB), vibration, bending moment, torque, pressure, temperature, resistivity, permeability, porosity, etc.

In FIG. 2, there is illustrated an embodiment of sensor 30 that includes a cutting element 25A that may be dynamically coupled to a sensing element 31. The sensor 30 may be disposed in a pocket 26 or cavity. In one embodiment, the sensor 30 may include a material that exhibits a change in a material property. This change may be measured to estimate parameters such as pressure, temperature, strain, etc. During operation, the cutting element 25A engages a wellbore surface such as a well bottom 17. The sensing element 31 responds to a motion, movement, or condition of the cutting element 25A by generating a representative signal.

Figure 3:
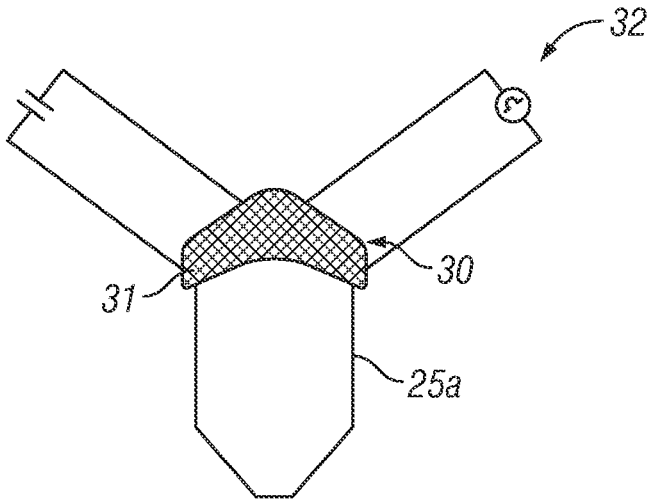
FIG. 3 schematically illustrates a cutting element having a control circuit according to one embodiment of the present disclosure.

Referring now to FIG. 3, in some embodiments, the sensor 30 may include a sensing element 31 that exhibits a change in an electrical property. A control circuit 32 in operative communication with the sensing element 31. The control circuit 32 may be configured to estimate an electrical parameter (e.g., voltage, current, resistance, capacitance, etc.), a magnetic parameter, or other parameter associated with the material 30. For instance, in response to an applied pressure, the material may deform, which may produce information corresponding to the deformation in the form of an electromagnetic signal. The control circuit 32 may store the information in a suitable downhole memory (not shown) and/or transmit the information uphole.

Figure 4:
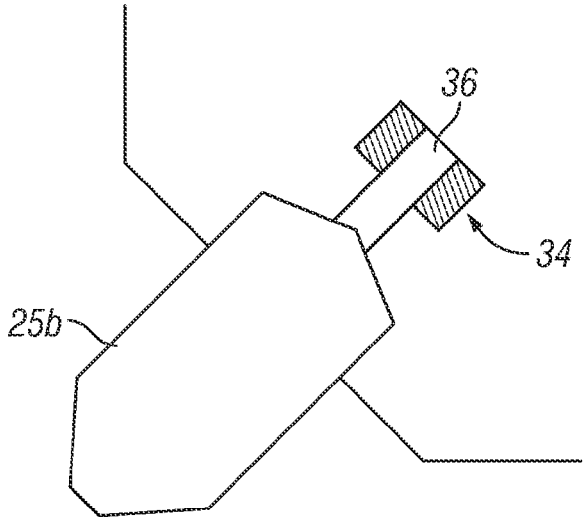
FIG. 4 schematically illustrates a cutting element having a pressure sensing element according to one embodiment of the present disclosure.

Referring now to FIG. 4, in one embodiment, the cutting element 25*b* may be operatively coupled to a sensing element 34 that generates a signal representative of a pressure applied to the cutting element 25*b*. The pressure may be due to the weight on bit. The sensing element 34 may be in communication with a pressure transferring material 36. The pressure transferring material 36 may be a solid that is a part of the cutting element 25*b*, a gel or a fluid. In some embodiments, the sensing element 34 may be a strain sensor that generates a signal indicative of a change in length of a sensing element associated with the strain sensor. The sensor 34 may be calibrated to generate a signal that may be processed to estimate a pressure (e.g., contact pressure) between the cutting element 25*b* and the formation.

Figure 5:
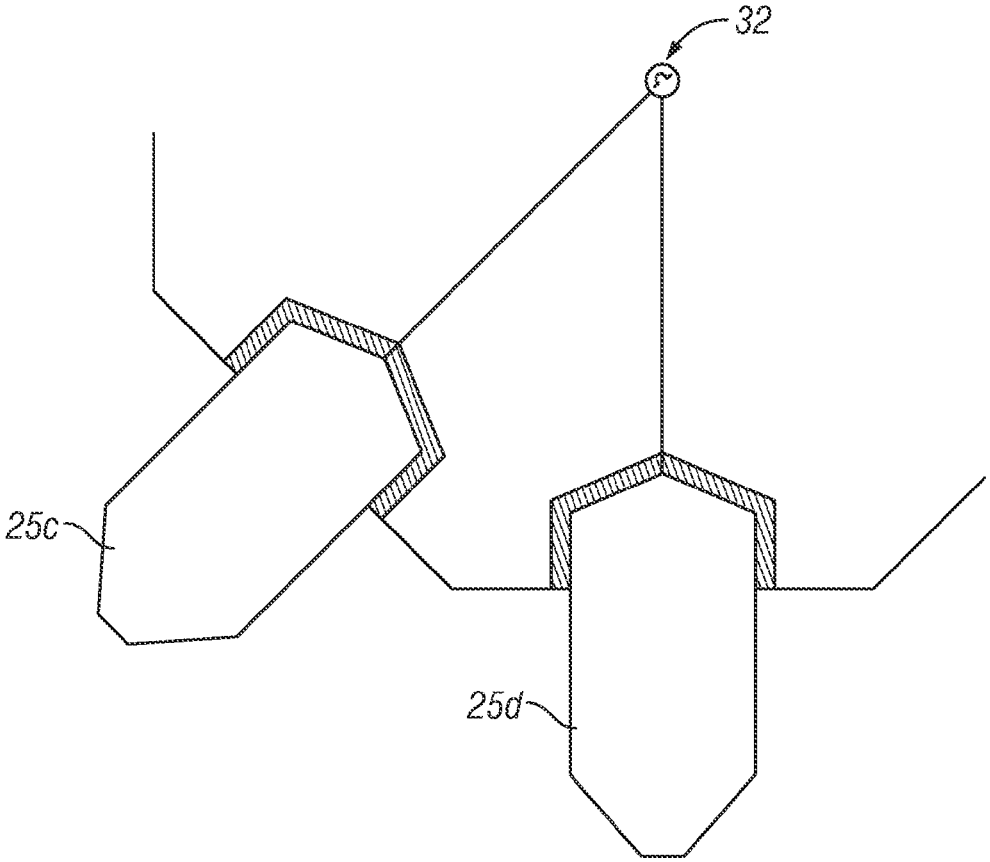
FIG. 5 schematically illustrates a resistivity sensing device used with two cutting elements according to one embodiment of the present disclosure.

Referring now to FIGS. 1 and 5, in one embodiment, the sensor 30 may use cutting elements 25*c,d* electrically coupled to a control circuit 32 to estimate a formation parameter such as resistivity. For instance, each cutting element 25*c,d* may be in electrical communication with a control circuit 32 (FIG. 3) configured to estimate the resistance of the material making up the formation in contact with the cutting elements 25*c,d*. In this embodiment, the cutting elements 25*c,d* may function as electrodes. During operation, the current flows through the material between the cutting elements 25*c,d*. The control circuit 32 may be configured to estimate a resistivity or other electrical parameter of the material between the cutting elements 25*c,d*.

In still other embodiments, the drill bit 10 may include a sensor 30 that includes a signal generator 40 and a receiver 42. The signal generator 40 directs a signal into the formation and the receiver 42 detects a response from the formation. The response may be a reflected signal, a radioactive decay, etc. In one embodiment, the signal generator 40 may be an acoustic source. The signal generator 40 may use the cutting element 25*b* as a focusing element or wave guide to direct the acoustical signal or other form of energy wave into the formation. The receiver 42 may detect the reflections of the acoustical signals. In other embodiments, the signal may be radiation, an NMR signal, an electromagnetic signal, a microwave.

Numerous systems may be used to transmit signals to and receive signals from the sensors and devices described above. For example, referring to FIG. 1, the drill bit 10 may include an information acquisition system 50 that may include a controller 52 and communication devices 54 that are used to operate the sensors and other devices described above. The controller 52 may include an information processing device. Information processing device as used herein means any device that transmits, receives, manipulates, converts, calculates, modulates, transposes, carriers, stores or otherwise utilizes information. In several non-limiting aspects of the disclosure, an information processing device may include a computer or microprocessor that executes programmed instructions. The communication device 54 may utilize signal transmitting media based on RF, acoustic, pressure pulses, EM, etc.

Figure 6:
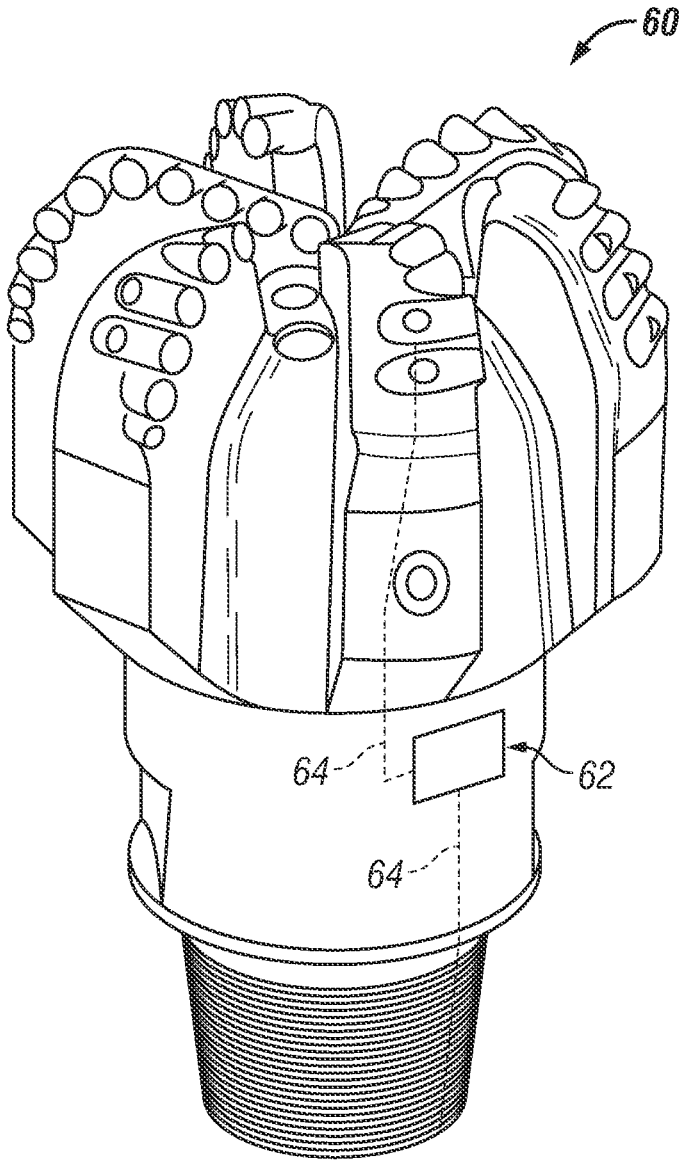
FIG. 6 isometrically illustrates an instrumented PDC drill bit according to one embodiment of the present disclosure.

Referring to FIG. 6, there is shown a polycrystalline diamond compact (PDC) drill bit 60. The drill bit 60 may include one or more sensors and devices described in connection with FIGS. 1-5 above. In this embodiment, an information acquisition system 62 may include a controller in communication with one or more sensors (not shown) in the drill bit 60. The controller, which may process information and transmit/receive signals, may use signal carriers 64 to transmit/receive data from the sensors and/or to transmit/receive data from a BHA (not shown) or the surface. The controller may include an information processor that is data communication with a data storage medium and a processor memory. The data storage medium may be any standard computer data storage device, such as a USB drive, memory stick, hard disk, removable RAM, EPROMs, EAROMs, flash memories and optical disks or other commonly used memory storage system known to one of ordinary skill in the art including Internet based storage. The data storage medium may store one or more programs that when executed causes information processor to execute the disclosed method(s). 'Information' may be data in any form and may be "raw" and/or "processed," e.g., direct measurements, indirect measurements, analog signal, digital signals, etc.

It should be understood that the present teachings may be used in nearly any situation wherein it is desirable to evaluate a cutting action dynamics and/or characterize a material into which cutters penetrate. For example, some devices may be used to enlarge a bore formed by primary drill bit, such as the bits shown in FIGS. 1 and 6. Such hole enlargement devices include reamers and underreamers that enlarge holes drilled by a primary bit. Moreover, the present teachings may be applied to other cutters, such as cutters used in liner drilling systems, and cutters used to cut materials other than rock and earth, such as metal, composites, etc.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. A drill bit, comprising:

a bit body; and a sensor in the bit body, the sensor including at least one cutting element, the sensor being configured to generate information related to at least one of a pressure, a strain and a temperature of the cutting element in response to transfer of a motion of the at least one cutting element to the sensor when the at least one cutting element engages a wellbore surface.

2. The drill bit of claim 1, wherein the generated information further relates to one of: (i) a formation parameter, (ii) temperature of a surrounding media, and (iii) vibration.

3. The drill bit of claim 1, wherein the sensor includes a sensing element dynamically coupled to the at least one cutting element.

4. The drill bit of claim 3, wherein the generated information is due to a change in an electrical parameter of a material deformed by the motion of the at least one cutting element.

5. The drill bit of claim 1, wherein the at least one cutting element comprises at least two cutting elements engaged with the wellbore surface, and a control circuit is configured to flow current through formation material between the at least two cutting elements to determine a resistivity of the formation.

6. The drill bit of claim 1 further comprising a signal generator configured to transmit a signal into the formation, and a receiver configured to generate a signal indicative of a response of the formation to the transmitted signal.

7. The drill bit of claim 1 further comprising a circuit in the bit body configured to at least partially process signals from the sensor.

8. The drill bit of claim 1, wherein the generated information is further related to a condition of the cutting element.

9. A drill bit, comprising:

a bit body;

a sensor in the bit body, the sensor including at least one cutting element and a sensing element operatively coupled to the at least one cutting element, the sensor being configured to generate information related to at least one of a pressure, a strain and a temperature of the cutting element in response to transfer of a motion of the at least one cutting element to the sensor when the at least one cutting element engages a wellbore surface;

a controller configured to operate the sensor; and a communication device configured to provide signal communication between the controller and the sensor.

10. The drill bit of claim 9, wherein the generated information relates to one of: (i) a formation parameter, (ii) temperature of a surrounding media, and (iii) vibration.

11. The drill bit of claim 9, wherein the generated information is due to a change in an electrical parameter of a material deformed by the motion of the at least one cutting element.

12. The drill bit of claim 9, wherein the at least one cutting element comprises at least two cutting elements engaged with the wellbore surface, and a the controller is further configured to flow current through formation material between the at least two cutting elements to determine a resistivity of the formation.

13. The drill bit of claim 9 further comprising a signal generator configured to transmit a signal into the formation, and a receiver configured to generate a signal indicative of a response of the formation to the transmitted signal.

14. The drill bit of claim 9 further comprising a circuit in the bit body configured to at least partially process signals from the sensor.

* * * * *